US005999898A

United States Patent [19]

Richter

[11] Patent Number: 5,999,898

[45] Date of Patent: Dec. 7, 1999

[54] VOICE/DATA DISCRIMINATOR

[75] Inventor: Gerard Richter, Saint-Jeannet, France

[73] Assignee: International Business Machines Corporation, Armonk, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/831,270

[22] Filed: Mar. 31, 1997

[30] Foreign Application Priority Data

Jun. 20, 1996 [FR] France ..... 96 480082

[51] Int. Cl.[6] ..... G10L 9/08

[52] U.S. Cl. ..... 704/217; 704/212

[58] Field of Search ..... 704/200, 212, 704/214, 229, 232, 213, 219, 217, 216, 218, 224, 263

[56] References Cited

U.S. PATENT DOCUMENTS

| | | | |
|---|---|---|---|
| 4,815,136 | 3/1989 | Benvenuto | 704/237 |
| 4,815,137 | 3/1989 | Benvenuto | 704/234 |
| 4,912,765 | 3/1990 | Virupaksha | 704/229 |
| 5,295,223 | 3/1994 | Saito | 704/214 |
| 5,315,704 | 5/1994 | Shinta et al. | 704/232 |

*Primary Examiner*—Richemond Dorvil
*Attorney, Agent, or Firm*—Gerald R. Woods

[57] ABSTRACT

A method and apparatus for discriminating between voice and voiceband data (fax/modem data) in an input signal from a voiceband channel, which is available by blocks (packets) of samples. Said discrimination is based upon the computation of two characteristics of the input signal: an autocorrelation function and a power variation function, the combination of which provides a discrimination factor which is highly accurate while requiring a low computing power.

7 Claims, 4 Drawing Sheets

| | $\frac{\text{Delta-Power}}{\text{Mean-Power}} < 1$ | $\frac{\text{Cor}}{\text{Mean-Power}} < -0.2$ | Decision |
|---|---|---|---|
| 601 | YES | YES | – |
| 602 | YES | NO | Voice-band data |
| 603 | NO | YES | voice |
| 604 | NO | NO | – |

VOICE/DATA DISCRIMINATOR

TECHNICAL FIELD

The present invention relates to a speech/voiceband data discriminator for determining whether an input signal from a digital voice channel is speech signal or voiceband data signal.

BACKGROUND ART

The evolution of digital networks in the last past years caused a fundamental shift in the customer traffic profile. Now, using the new networking technologies e.g. high speed packet switching networks allows the customer to integrate data, voice and video information digitally encoded, chopped into small packets and transmitted through the network. An efficient transport of mixed traffic streams on very high speed lines means for these new network architectures a set of requirements in terms of performance and resource consumption. One major requirement is the efficient management of the bandwidth allocation since transmission costs are likely to continue to represent the major expense of operating future telecommunication networks, as the demand for bandwidth increases driven by new applications and new technologies.

In digital transmission of voiceband signals, two types of signal can be present on a standard 64 kbps (thousand bits per second) PCM (Pulse Code Modulation) encoded digital voice channel, depending on whether it is voice (speech) or FAX and/or modem data (commonly referred to as voiceband data). When the signal is voice, bandwidth can be saved by using voice compression algorithms capable of reducing significantly the data rate in voice circuits without measurable loss of quality. Many voice compression algorithms rely on the fact that a voice signal has considerable redundancy, and then, the characteristics of the next few samples can be predicted from the last few ones. One of the most common voice compression algorithm based on the prediction method is the GSM (Group Special Mobile) technique. Using GSM compression technique allows a speech data stream to be compressed at a rate of 13 kbps compared to the initial bit rate of 64 kbps. Unfortunately applying such a compression algorithm (i.e. GSM) to voiceband data signals would increase dramatically the bit error rate. Consequently voiceband data should be either encoded at a higher bit rate so as to keep the data error rate in a permissible limit, or demodulated to extract the data, or kept transmitted at the initial 64 kbps.

Therefore, the necessity to apply selectively a high compression technique for bandwidth saving purpose to signals from a digital voice channel depending on whether they are speech or voiceband data, implies the use of an accurate speech/voiceband data discriminator.

Such speech/voiceband data discriminators already exist in the background art.

Publication "IEEE Transactions Communications, Vol. COM-30, No. 4, April 1982—*Highly Sensitive Speech Detector and High-Speed Voiceband Data Discriminator in DSI-ADPCM Systems*" by Yohtaro Yatsuzuka describes a high speed voiceband data discrimination technique. The discrimination between voiceband data and speech is based on a short-time energy, a zero-crossing rate and coefficients of an adaptive predictor. U.S. Pat. No. 5,295,223 issued on Mar. 15, 1994 to Saito (Japan) entitled "*Voice/voice band data discrimination apparatus*" discloses an apparatus for discriminating voice data so as to create statistical data and for discriminating voice/voice band data in digital speech interpolation and digital circuit multiplication equipment. A comparison is made between the dead zone width and the amplitude of the input signal so as to count only how many times the input signal crosses the width of each dead zone as the number of zero crosses.

U.S. Pat. No. 5,315,704 issued on May 24, 1994 to Shinta et al. (Japan) entitled "Speech/voiceband data discriminator" discloses an apparatus whereby input signals are processed to generate a plurality of signals having different features according to whether the input signals are speech signals or voiceband data signals, and these plural signals are entered into a neural network to be determined whether they have features closer to those of speech signals or of voiceband data signals. The classifying function of the neural network is achieved by inputting samples of speech signals and voiceband data signals and learning how to obtain correct classification results. Short time energies and zero crossing rates of input signals are both fed in parallel to the neural network for classification decision.

The prior art speech/voiceband data discriminators referred to above generally imply a complex processing and their discrimination accuracy is generally perfectible with maybe the exception of the last above mentionned prior art wherein a neural network is used for making the final decision but which is accordingly complex to implement.

The speech/voiceband data disclosed is the present application offers a high discrimination accuracy while requiring a low computing power, which makes it easy to implement and particularly suitable for applications wherein many voiceband channels have to be processed simultaneously.

SUMMARY OF THE INVENTION

It is therefore an object of this invention to provide a speech/voiceband data discriminator which is highly accurate although it requires a low computing power.

Another object of this invention is to provide a speech/voiceband data discriminator for applying to signals issuing from a voiceband channel.

Another object of this invention is to provide a speech/voiceband data discriminator to be used in a high speed packet switching network node in order to optimize the bandwidth allocation of voiceband channels connected thereto.

A Speech/voiceband data discriminator according to the present invention utilizes two characteristics of an input voiceband channel signal as decision criteria: the normalized second-order autocorrelation function computed within a given time window and the normalized power variation computed over a given number of such windows. The combined computation of estimated values of these two characteristics, besides requiring a low computing power, provides a very accurate decision criterion.

These and other objects, features and advantages of the present invention will become apparent from the following detailed description and the appended claims, taken in conjunction with the accompanying figures, which specify and show a preferred embodiment of the invention.

DETAILED DESCRIPTION OF THE INVENTION

Figure 1:
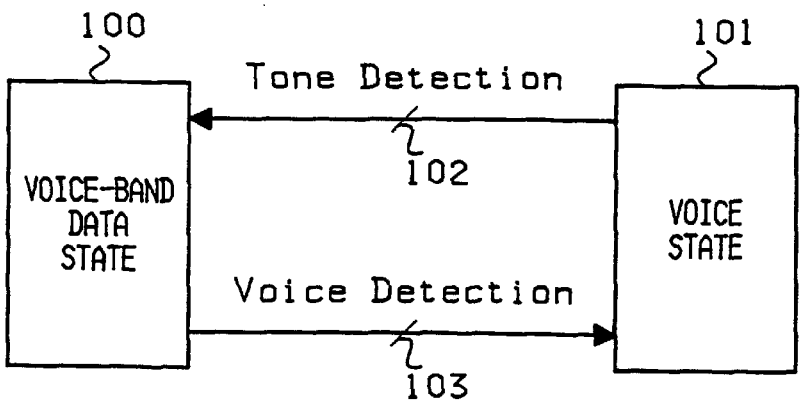
FIG. 1 depicts a simple state machine which illustrates the operation performed by the invention in its preferred embodiment.

In the following preferred embodiment of the invention the environment is a high speed network node to which are connected standard 64 kbps PCM voiceband channels, for example through a 2 mbps (million bits per second) E1 trunk (32 standard voice channels multiplexed using Time Division Multiplexing Technique (TDM)). Inside the network node and more precisely in a voice server, each 64 kbps voiceband channel is available by packet of 160 samples (1 sample=8 bits), representing 20 milliseconds. Then, each channel is processed according to the state machine of FIG. 1. In state 100 the signal issued from the voiceband channel has been declared as being fax/modem data and voice detection 103 is activated u sing the voice/data discriminator of the present invention. When voice is detected state 101 becomes valid and tone detection 102 is activated to detect fax/modem data . When fax/modem data is detected the state machine switches back to state 100.

When the input signal is speech as in state 101, a compression algorithm (GSM) is run for reducing the bandwidth allocation from 64 kbps to 13 kbps. In state 100 where input signal is voiceband data (fax/modem data) a bandwidth higher than 13 kbps is requested. To detect fax/modem data when in "voice state" 101, the voice/data discriminator of the present invention could also have been used. Nevertheless, as a fax/modem connection always starts by the exchange on the line of tones of 2100 Hz and 1100 Hz, a common tone detector to identify these specific tones is sufficient. Accordingly in this embodiment, the present invention has been selectively used for voice detection.

The voice/data discriminator disclosed herein is based upon the computation of two characteristics of the input signal which are the second-order autocorrelation function (herein referred to as Cor) computed within a 20 milliseconds (ms) time window and the power variation (herein referred to as Delta_Power) computed within a given number of 20 ms windows (in the present embodiment this number is ten). The 20 ms window, which is referred to as Window in the rest of the document, corresponds to the time interval required to receive one packet of 160 8-bit samples of a signal from a 64 kbps PCM channel. These two characteristics are then "normalized" i.e. divided by the mean power (herein referred to as Mean_Power) of the input signal. The "normalization" of these two characteristics of the incoming signal allows proper detection whatever the signal amplitude is.

Figure 2:
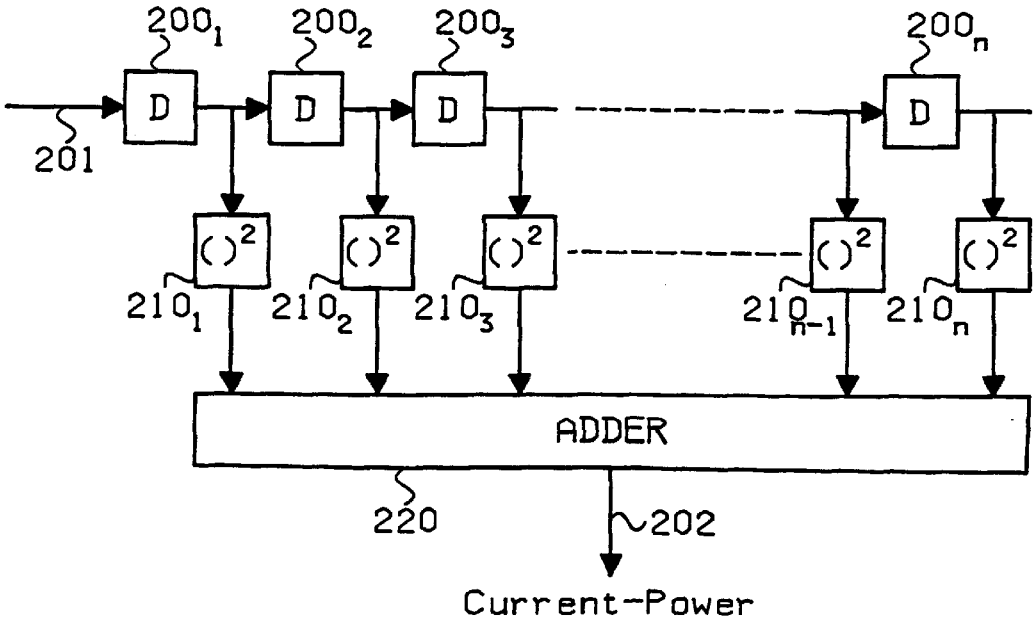
FIG. 2 is a block diagram that illustrates the method whereby the input signal current power (Current_Power) is computed within a given time window.
Figure 3:
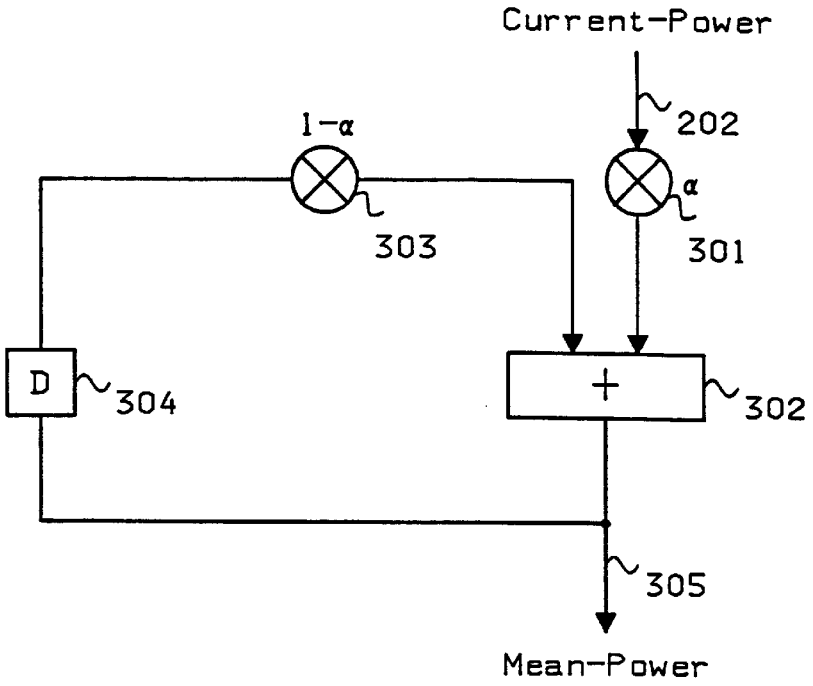
FIG. 3 is a block diagram that illustrates the method whereby the input signal's mean power (Mean_Power) is computed from the current power value computed as described in FIG. 2.

FIG. 2 and 3 show how the Mean_Power is computed from the incoming signal. In FIG. 2 the incoming signal 201 is fed into a delay line contituted of n (n=160) delay circuits 200 to extract a set of 160 consecutive values (corresponding to the 160 samples included in one packet) from the incoming signal. These values are then squared by the n operators 210, and the results are accumulated by adder 220 to provide the current power 202 (referred to as Current_Power) of the input signal 201 within one Window.

The block diagram of FIG. 2 describes the calculation of Current_Power according to the following equation $$Current_Power(w) = \sum_{i=0}^{159} x(i + 160 \cdot w)$$

w is an integer representing the current Window for which the Current_Power is calculated.

x(n): n is an integer, is one sample value within the current Window w.

In FIG. 3 Current_Power(w) 202 obtained as in FIG. 2 is integrated over a given time span to provide the Mean_Power(w) value. Current_Power 202 is multiplied by a factor alpha in operator 301 and is added in additioner 302 to the "old" value of Mean_Power i.e. Mean_Power(w−1) which has been previously multiplicated by factor 1-alpha in operator 303. The output of additioner 302 provides the "updated" value of Mean_Power(w) 305. Mean_Power(w) 305 is fed through a delay circuit 304 (delay is Window width i.e. 20 ms) the output of which provides the next "old" value of Mean_Power i.e. Mean_Power(w−1) since w is incremented at each current Window shift.

The block diagram of FIG. 3 allows the calculation of Mean_Power according to the following equation $$Mean_Power(w)=(1\text{-}alpha)\cdot Mean_Power(w-1)+alpha\cdot Current_Power(w)$$

Practically, the calculation of Mean_Power according to the hereabove equation is applied to integrate Current_Power over a number N of successive Windows of the incoming signal (i.e. for w−N to w). The value of factor alpha is related to the number N chosen. In the preferred embodiment of the invention alpha=1/16.

Figure 4:
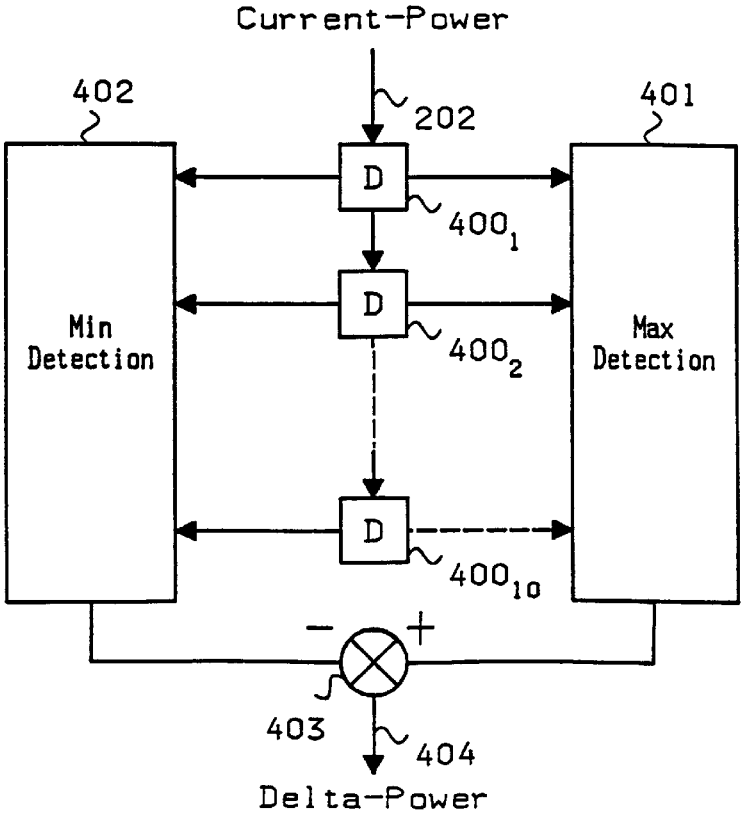
FIG. 4 is a block diagram illustrating the method whereby is computed the input signal power variation (Delta_Power) over a given time window.

FIG. 4 depicts the method whereby the power variation of the input signal is estimated. This estimation is herein referred to as Delta_Power. Referring to FIG. 4, Current_Power values calculated as depicted in FIG. 2 are inputted into a delayline 400 made of 10 delay circuits to "extract" 10 successive values of Current_Power (corresponding to 10 successive Windows). The minimum of this set of values is then searched in the operator 402. Similarly, the maximum is searched by operator 401. The minimum value is then subtracted from the maximum value by subtractor 403, resulting in Delta_Power 404. It should be noticed that both the maximum and minimum values are positive and that the maximum is greater or equal to the minimum, resulting in a positive Delta_Power value. The operator 401 of FIG. 4 computes the maximum value (Max_Power) among 10 stored Current_Power values according to the following equation:

$$Max_Power(w)=Maximum(Current_Power(w-i)) \text{ where } i=0 \text{ to } 9$$

Similarly the operator 402 computes the minimum value (Min_Power) as following:

$$Min_Power(w)=Minimum(Current_Power(w-i)) \text{ where } i=0 \text{ to } 9$$

Finally Delta_Power 404 is computed as follows:

$$Delta_Power(w)=Max_Power(w)-Min_Power(w)$$

Then, the input signal power variation Delta_Power is normalized by Mean_Power to provide the normalized power variation of the input signal:

Norm_Delta_Power(w)=Delta_Power(w)/Mean_Power(w)

The normalized power variation (Norm_Delta_Power) of the input voiceband signal provides an estimation of its stationary character. Beyond one Window (i.e. one packet of 160 8-bit samples), speech is typically a non-stationary signal while voiceband data are stationary signals. Simulations have shown that Norm_Delta_Power takes values greater than "1" for voice and values smaller than "1" for fax/modem signals. Thus, it was decided to take "1" as threshold value (referred to as p_threshold) and to set a decision flag (referred to as p_decision) according to the comparison between Norm_Delta_Power and p_threshold. The voice/data discrimination according to the normalized power variation criterion is summarized in the following table:

| Norm_Delta_power | Signal type | p_decision flag |
|---|---|---|
| >p_threshold | voice | 0 |
| <p_threshold | fax/modem or tone | 1 |

Figures 5, 6:
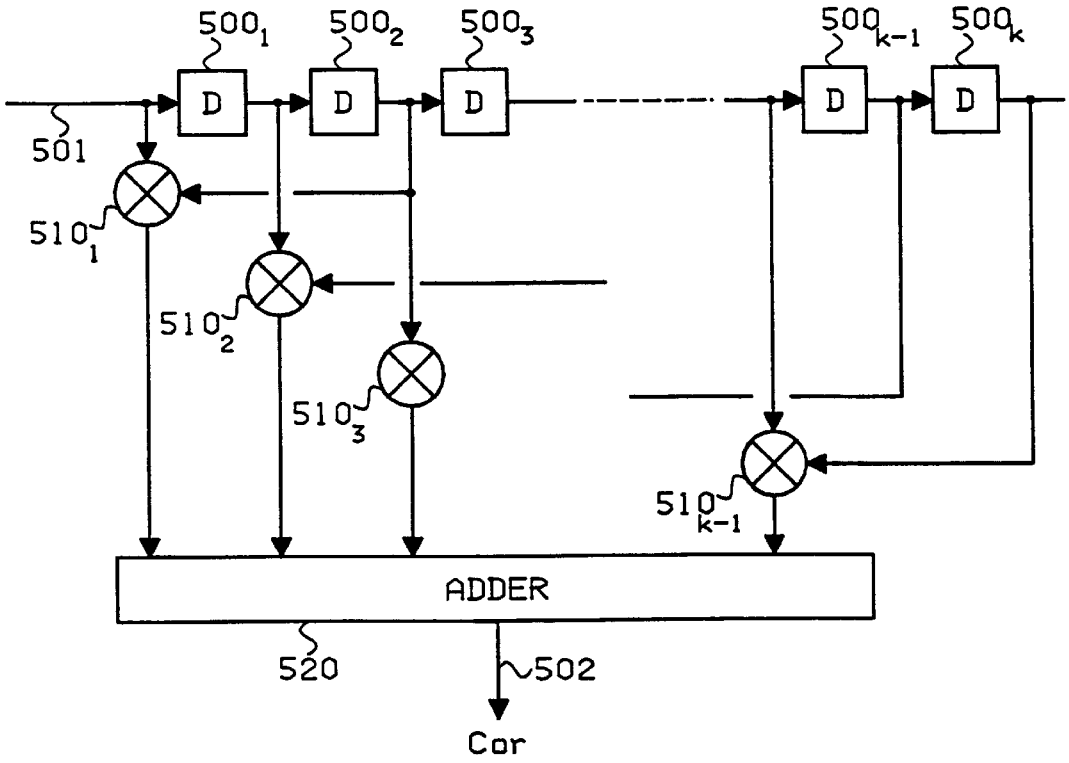
FIG. 5 is a block diagram illustrating the method whereby the second-order autocorrelation function (cor) of the input signal is computed over a given time window.
FIG. 6 is a block diagram that illustrates the method whereby the voice/data decision is taken from the normalized values of Delta_Power and Cor of the input signal.

FIG. 5 is an illustration of how is computed an estimation of the second-order autocorrelation function (herein referred to as Cor) which, when normalized, constitutes the second criterion for speech/voiceband data discrimination according to the present invention. Referring to FIG. 5, the incoming signal 501 enters a delay line 500 made of k (k=160) delay circuits, providing 160 successive samples. Each sample x(i) (i: integer) is multiplied by sample x(i+2) by multipliers 510. Then, these results are accumulated by adder 520 to provide the "Cor" value 502. "Cor" is thus calculated according to the following equation:

$$Cor(w) = \sum_{i=0}^{157} x(i + 160 \cdot w) \cdot x(i + 2 + 160 \cdot w)$$

w is an integer representing the current Window for which Cor is calculated.

x(n): n is an integer, is one sample value within the current Window W.

The autocorrelation function provides information on the frequency spectral distribution of the signal. A fax/modem data spectrum is centered around 1800 Hz while speech data spectrum is statistically centered around 700 Hz. For this reason the "Cor" function takes a negative value for fax/modem type signal and takes a positive value for speech signals. Then, the function "Cor" is normalized providing the normalized 2nd-order autocorrelation function herein referred to as Norm_Cor:

Norm_Cor(w)=Cor(w)/Mean_Power(w)

Simulations have shown that for voiceband data Norm_Cor<"−0.5" whereas for speech: Norm_Cor>"0".

In accordance with these results, a value of "−0.2" has been chosen as threshold (referred to as r_threshold) and a decision flag (referred to as r_decision) takes the values "0" or "1" according to the result of the comparison between Norm_Cor and r_threshold. The voice/data discrimination according to the normalized 2nd-order autocorrelation criterion is summarized in the following table

| Norm_Cor | Signal type | r_decision flag |
|---|---|---|
| >r_threshold | voice or tone | 0 |
| <r_threshold | fax/modem or tone | 1 |

Note: using this criterion, tones cannot be discriminated from other signals (i.e. speech or fax/modem data).

Now referring to FIG. 6 the two above criteria are combined to provide the accurate discrimination means that is claimed by the present invention. The decision whether the input signal is speech or voiceband data is taken according to the comparison between the estimations of functions Norm_Delta_Power and Norm_Cor and their respective threshold values (p_threshold and r_threshold). In row 603, voice decision is assumed because both criteria indicate voice type signal. Similarly, in row 602 voiceband data decision is assumed since both criteria indicate voiceband data type signal. The two other rows correspond to no-decision states because the two criteria gives contradictory results. However, the cases of rows 601 and 604 have a very low probability to occur and, if such situation arises the final decision state keeps unchanged.

The combination of the two above criteria presents the advantage of lowering the probability of declaring voice instead of fax/modem data and it also allows to include tones signals within fax/modem detection. The decision taken within each Window (Window_Decision) is then integrated over a given number of preceding Windows to report a "mean decision" (Mean_Decision), according to the following equation:

Mean_Decision(w)=(1-beta)·Mean_Decision($w$−1)+ beta·Window_Decision($w$)

In practice, the Window_Decision is integrated over a given number of successive Windows of the incoming signal that is, for w−N to w where N is the number of windows chosen. The number N is chosen in order to provide the accuracy required for Mean_Decision(w) calculation. Mean_Decision(w) is herein referred to as discrimination factor. The factor "beta" of the above equation is related to the number N chosen. In the preferred embodiment of the invention, beta=1/16 and all power and autocorrelation estimations are computed with a 32 bits precision, in order to avoid any underflow or overflow related problems.

The discrimination factor computed over a given number N of Windows can take any value from "0" to "1" thus, in order to avoid oscillatory decision transitions, two threshold values have been chosen to determine the transition from state "speech" to state "voiceband data" and the opposite transition, according to an hysteresis loop. In the preferred embodiment the upper threshold is "0.8" and the lower one is "0.2".

Figure 7:
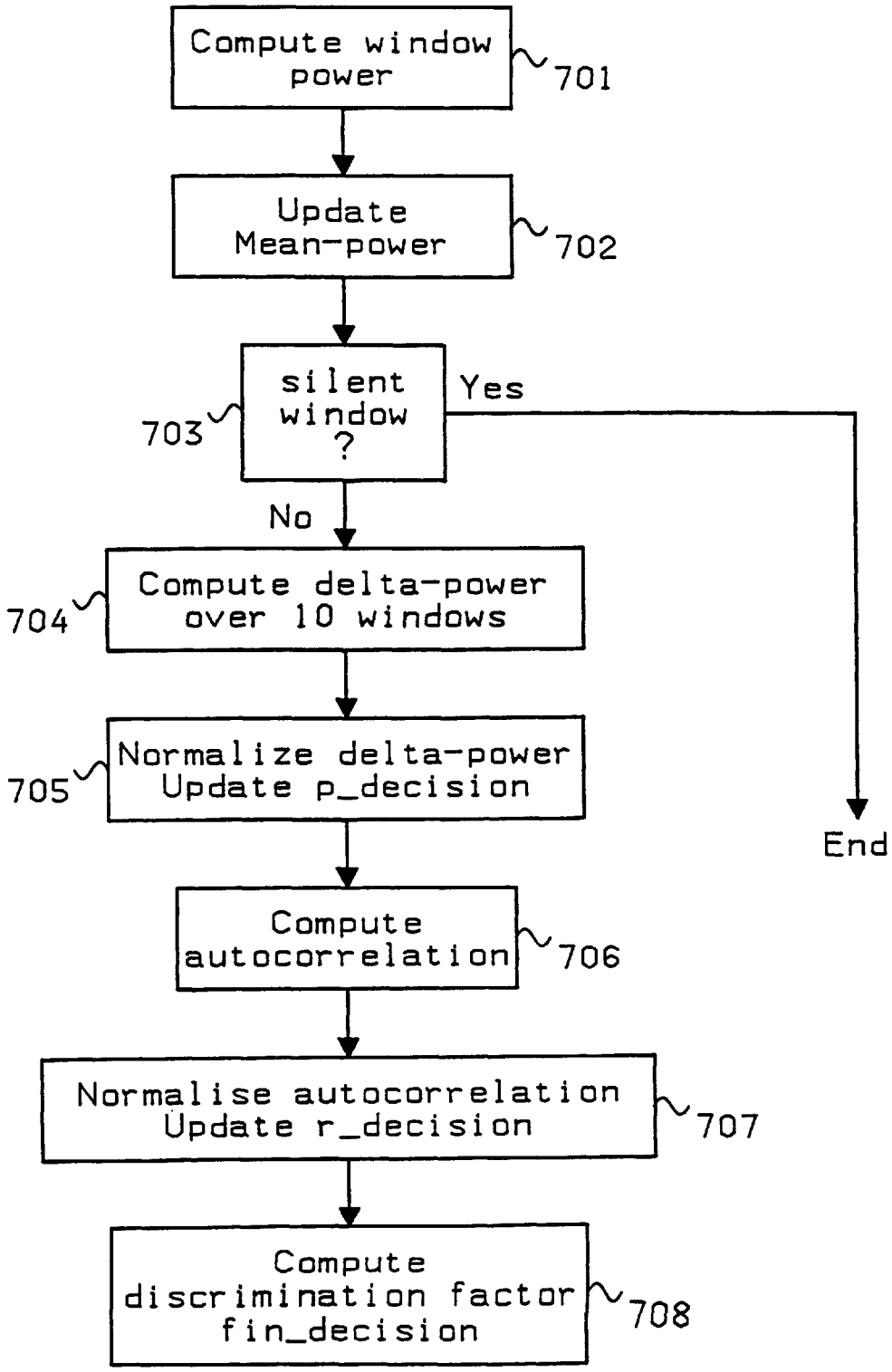
FIG. 7 is a flow chart of the overall process of speech/data discrimination in accordance with the present invention.

FIG. 7 depicts the complete speech/voiceband data discriminator algorithm. In step 701, the power of the current Window (Current_Power(w)) is calculated as in FIG. 2. In step 702 the mean power of the current Window (Mean_Power(w)) is updated as in FIG. 3. In step 703 a test is done to determine if the current Window is a "silent" Window (that is no signal is transmitted within the Window). If the Window current power is lower than a given threshold value, it is assumed that the current Window is a "silent" Window and no other calculation is done. If the current Window is not a "silent" Window then its power variation (Delta_Power (w)) is computed as shown in step 704, according to the process of FIG. 4. In step 705 Delta_Power(w) is normalized (i.e. divided by Mean_Power(w)) and voice/data decision is made regarding the Delta_Power criterion, resulting in the update of p_decision flag. In step 706 the 2nd-order autocorrelation function of the current Window (Cor(w)) is computed. In Step 707, Cor(w) is normalized and voice/data decision is made regarding the "autocorrelation" criterion, resulting in the update of r_decision flag. In step 708 the discrimination factor is computed and the final decision (fin_decision) is provided.

As set forth above, the present invention discloses a new voice/data discrimination technique which is based on an original combination of results from the calculation of two characteristics of an input voiceband signal so as to elaborate a discrimination factor which is highly accurate while requiring a low computing power. Consequently, the present invention is particularly suitable for applications where a plurality of voiceband channels have to be processed simultaneously with high precision.

While the invention has been described in terms of a single preferred embodiment, those skilled in the art will recognize that the invention can be practiced with modification within the scope of the appended claims.

What is claimed is:

1. A method for processing an input signal comprising the steps of:

computing a normalized power variation function of the input signal;

setting a first decision flag to a first value when the computed value of the computed normalized power variation function is indicative of a voice signal and to a second value when the computed value of the computed normalized power variation function is indicative of a voiceband data signal;

computing a normalized second-order autocorrelation function of the input signal;

setting a second decision flag to a first value when the computed value of the normalized second-order autocorrelation function is indicative of a voice signal and to a second value when the computed value of the normalized second-order autocorrelation function is indicative of a voiceband data signal;

combining the first and second decision flags to finally identify the input signal as either a voice signal or as a voiceband data signal;

applying a first set of signal processing operations to any input signal finally identified as a voice signal; and applying a second set of signal processing operations to any input signal finally identified as a voiceband data signal.

2. The method defined in claim 1 wherein the step of computing the normalized power variation function comprises the steps of:

computing the power level of the input signal within a current window of several input signal samples;

computing a value for the mean power function of the input signal;

computing a value for the power variation function of the input signal; and dividing the computed power variation function value by the computed mean power function value.

3. The method according to claim 1 wherein the step of setting the first decision flag further comprises the step of comparing the computed value of the normalized power variation function to a first predetermined threshold to assign a first value indicative of a voice signal or a second value indicative of a voiceband data signal.

4. The method according to claim 3 wherein the first value is assigned when the computed value of the normalized power variation signal is less than the first predetermined threshold and the second value is assigned when when the computed value of the normalized power variation signal is greater than the first predetermined threshold.

5. The method according to any one of claims 2–4 wherein the step of computing the normalized second-order autocorrelation function of the input signal further comprises the steps of:

computing a value for a second-order autocorrelation function within a current window of several input signal samples; and dividing the computed second-order autocorrelation function value by the computed mean power function value.

6. The method according to claim 5 wherein the step of setting the second decision flag further comprises the step of comparing the computed value of the normalized second-order autocorrelation function to a second predetermined threshold to assign a first value indicative of a voice signal or a second value indicative of a voiceband data signal.

7. The method according to claim 6 wherein the step of combining the first and second decision flags further comprises the steps of:

providing a first decision value within a current window of several input signal samples if the first and second decision flags are both indicative of the same type of signal or a second decision value within the current window of several input signal samples if the first and second decision flags are not indicative of the same type of signal;

integrating the decision values provided in the preceding step over a predermined number of windows to product a discrimination factor;

comparing the discrimination factor to a third predetermined threshold when the input signal had previously been identified as a voice signal; and comparing the discrimination factor to a fourth predetermined threshold when the input signal had previously been identified as a voiceband data signal.

* * * * *